United States Patent [19]

Silvon

[11] 4,353,277

[45] Oct. 12, 1982

[54] SAW CHAIN

[75] Inventor: Kay Silvon, Portland, Oreg.

[73] Assignee: Omark Industries, Inc., Portland, Oreg.

[21] Appl. No.: 148,810

[22] Filed: May 12, 1980

[51] Int. Cl.[3] ..... B27B 33/14

[52] U.S. Cl. ..... 83/833; 83/834

[58] Field of Search ..... 83/830, 831, 832, 833, 83/834

[56] References Cited

U.S. PATENT DOCUMENTS

| | | | |
|---|---|---|---|
| 2,872,956 | 2/1959 | Gudmundsen | 83/833 |
| 3,180,378 | 4/1965 | Carlton | 83/834 |
| 3,910,148 | 10/1975 | Weiss | 83/834 X |
| 3,951,027 | 4/1976 | Arff | 83/834 |
| 4,023,453 | 5/1977 | Dolata et al. | 83/833 X |
| 4,133,239 | 1/1979 | Goldblatt | 83/834 |

FOREIGN PATENT DOCUMENTS

| | | | |
|---|---|---|---|
| 406729 | 4/1974 | U.S.S.R. | 83/833 |

*Primary Examiner*—Donald R. Schran

*Attorney, Agent, or Firm*—Klarquist, Sparkman, Campbell, Leigh, Whinston & Dellett

[57] ABSTRACT

A saw chain includes a cutter link having a depth gauge with a rearwardly and upwardly sloping edge, and a guard link having a top edge generally paralleling the bottom of the kerf being cut by the saw chain. The guard link is further provided with a steep forward edge inclined upwardly and rearwardly toward the said top edge, and a rearward edge inclined upwardly and rearwardly wherein the rearward most portion of the guard link adjacent the following cutter link depth gauge is beneath a line extending between the top of the cutter link's cutting tooth and the peak of the depth gauge.

18 Claims, 5 Drawing Figures

SAW CHAIN

BACKGROUND OF THE INVENTION

The present invention relates to a saw chain and particularly to a saw chain having improved operating safety features.

An important aspect of saw chain design relates to ease and safety of operation. Saw chains may be provided with safety links or guard links adapted to avoid "kick back" and roughness of operation encountered when the upper part of the saw engages branches or brush, or when a cutter link becomes seized in the saw kerf. A chain of this general type is illustrated in Carlton U.S. Pat. No. 3,180,378 wherein a guard or camming surface is provided on a drive link or on a side link preceding a chain cutter link. More recently, a guard link has been suggested having a tail extending in overlapping relation to the depth gauge on the following cutter link wherein the guard link pivots outwardly as the saw chain rounds the curved end of the saw bar. This type of link is illustrated in Goldblatt U.S. Pat. No. 4,133,239. While reducing problems associated with kick back to a degree, this type of configuration has the disadvantage of deleteriously affecting the cutting ability of the chain, particularly in boring with the nose end of the bar of a chain saw. Moreover, because of the overall sloping or cammed surface of a long tail guard link, energy must be expended in camming wood chips towards the bottom of a kerf being cut and undesired angular movement of the guard link may result.

SUMMARY OF THE INVENTION

In accordance with the present invention, in a principal embodiment thereof, an improved saw chain includes a guard link provided with an upstanding body portion having an outer or top edge disposed in close proximity to the bottom of the kerf being cut, such top edge extending over a major part of the length of the guard link. Both the forward edge and the rearward edge of the guard link slope rearwardly and upwardly at a relatively steep angle whereby the top edge of the guard link may be nearly as long as the guard link. This configuration prevents wood penetration into the area between cutter links and conditions the kerf for the oncoming cutter link, whereby seizing of the cutter link depth gauge is substantially avoided. The guard link desirably fills the majority of the space between cutter links and includes a rearward most portion extending adjacent the depth gauge on the following cutter link. Such rearward most portion remains below a line extending between the top of the cutter link's cutting tooth and the peak of the depth gauge on the cutter link such that the action of the depth gauge remains primary in determining the depth of cut. Boring action of the saw chain is not substantially affected, but kick back is reduced to an extremely low level.

The saw chain desirably includes a cutter link having a rearwardly and upwardly sloping forward edge. Such forward edge is advantageously less apt to entrain brush or cause a seizing type contact with the kerf. The preceding guard link is then called upon to condition the kerf and exclude material to prevent seizing, kick back and the entrainment of brush, and does not have proportions as would interfere with operation of the cutter link for boring and the like.

It is accordingly an object of the present invention to provide an improved saw chain having greatly minimized kick back potential.

It is another object of the present invention to provide an improved saw chain wherein kick back is substantially eliminated without greatly affecting the cutting and boring capabilities of the saw chain.

It is another object of the present invention to provide an improved guard link for a saw chain wherein such guard link substantially reduces kick back while functioning to move wood chips along the saw kerf without binding.

It is another object of the present invention to provide an improved guard link for a saw chain for substantially eliminating kick back problems without preventing boring operations with the saw chain.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 1:
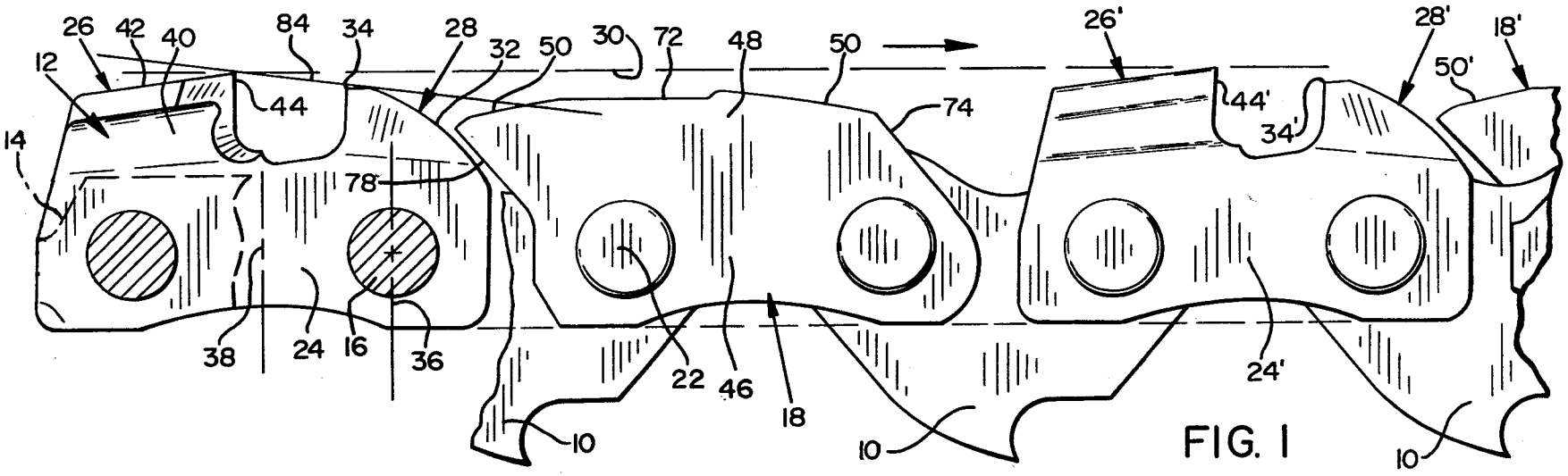
FIG. 1 is a side view, partially broken away, of a saw chain according to the present invention.
Figure 2:
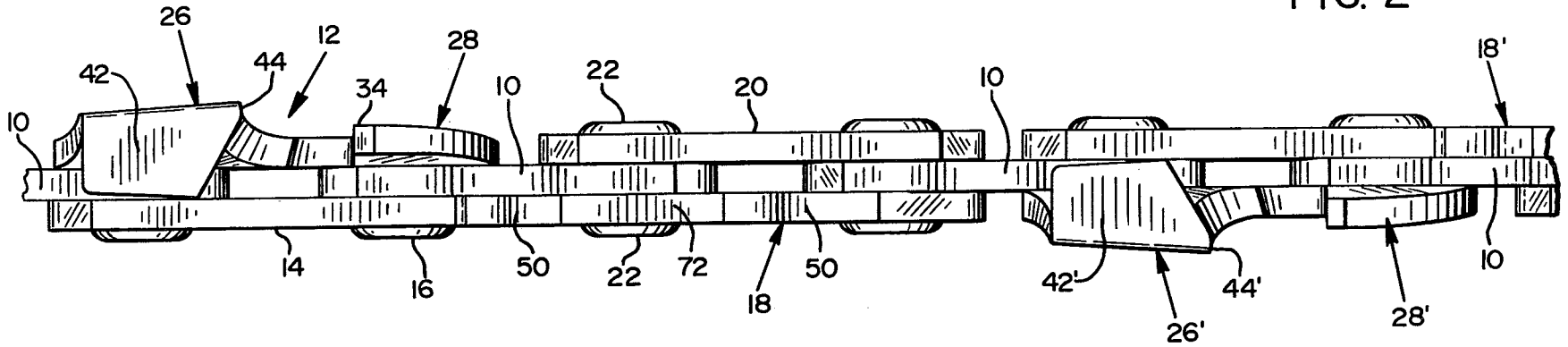
FIG. 2 is a top view of said saw chain.
Figure 3:
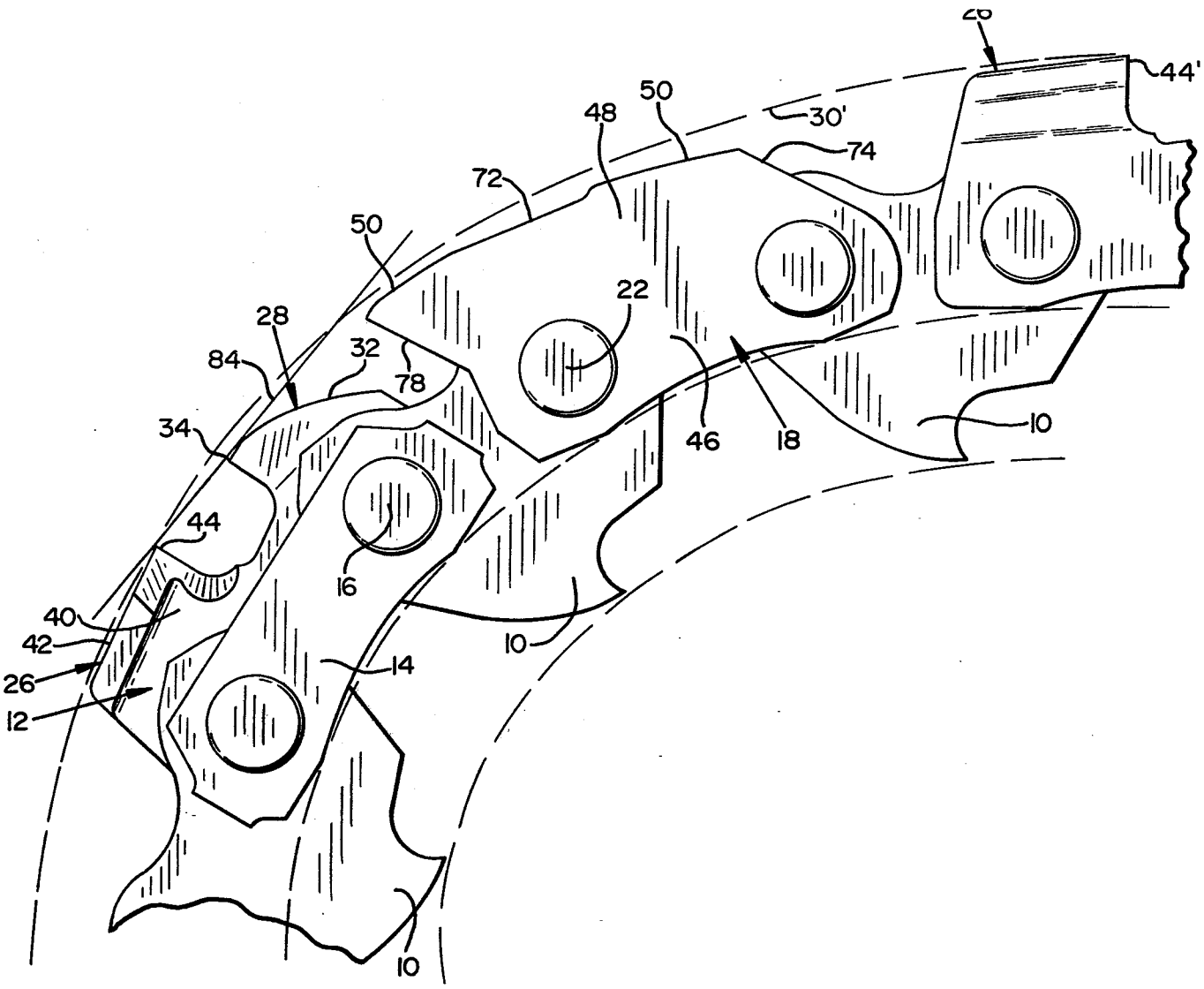
FIG. 3 is a side view of the saw chain according to the present invention, oriented as the same would traverse the nose end of a saw bar.

Referring to the drawings and particularly to FIGS. 1–3, a saw chain according to a specific embodiment of the present invention includes a plurality of center drive links 10 alternating with pairs of side links wherein a given pair of side links includes a cutter link 12 and a tie strap 14 pivotally secured to the center link by means of a rivet 16. The cutter links along the chain are suitably identical except that alternate cutter links are allochirial and are positioned on opposite sides of center links 10.

The cutter links 12 are comprised of a base 24 (corresponding in configuration to tie strap 14) carrying an upstanding cutting tooth 26 at the rear of base 24, and an upstanding depth gauge 28 at the forward end of the base. The cutting tooth and depth gauge both extend toward the bottom of the kerf cut by the saw chain, indicated by line 30 in FIG. 1, with the depth gauge having a height less than that of the cutting tooth for determining the depth of cut. Cutting tooth 26 includes a side plate 40 and a top plate 42 having a sharpened cutting edge 44. Depth gauge 28 has a forward edge 32 that is upwardly inclined toward a peak 34 located rearwardly of the vertical center line 36 of rivet 16, such forward edge desirably being curved with a center of curvature proximate the lower edge of the cutter link and closer to vertical center line 38 of the link than to the vertical center line 36 of rivet 16. The cutter link configuration including depth gauge 28 is of the type as set forth in Graversen U.S. Pat. No. 3,929,049 assigned to the assignee of the present invention.

Preceding each cutter link is a pair of side links including a guard link 18 and a tie strap 20 pivotally secured to the following center link 10 with rivet 22. The guard links are generally located on the opposite side of the chain from the succeeding cutter link and on the same side of the chain as the preceding cutter link, with each guard link including a base portion 46 (corresponding generally to the configuration of tie straps 14 and 20) from which body portion 48 upwardly extends. The guard link is plate-like, and may be flat, having lower forward and rearward edges adapted to ride along the side plates of the saw bar in the same manner as the tie straps. The guard link is adapted in profile substantially to fill the space between the preceding cutter tooth 26' and the succeeding depth gauge 28 whereby, for example, to prevent hooking engagement of the chain with brush and the like.

The upper or top edge 50 of the guard link 18 is disposed in upraised fashion for substantial alignment in general parallel relation along the bottom of the kerf cut by the saw chain as indicated at 30, in supporting relation to the chain along the kerf and in substantially parallel relation to the line of travel of the chain. The top edge is in substantial engagement with wood penetrating into the region between cutter links, conditioning the kerf for engagement with the oncoming depth gauge to prevent seizing of the depth gauge by the wood. Although top edge 50 is in relatively close spaced relation to the bottom of the kerf and substantially parallel to the line of travel of the chain, it is preferably curved having a large radius of curvature compared with the height of the guard link and compared with the pitch of the guard link between rivet hole centers. The radius of curvature of the top edge is suitably more than twice the pitch of the guard link between the rivet hole centers.

Figure 4:
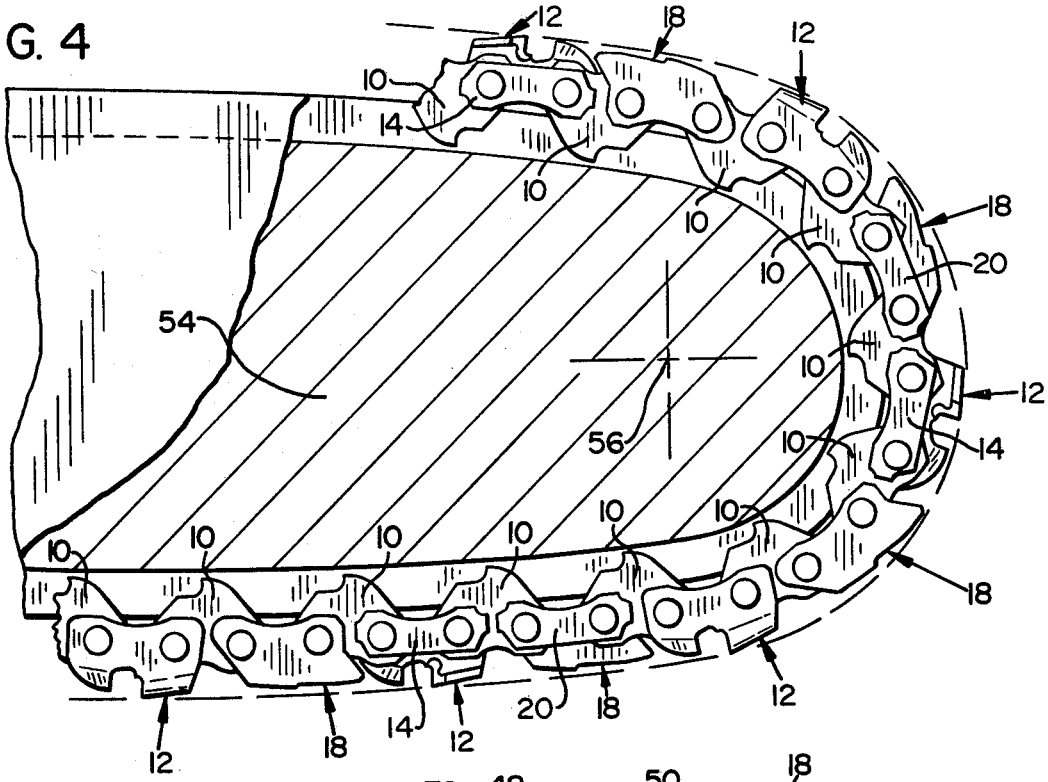
FIG. 4 is a side view, partially broken away, of the nose end of a saw bar having a saw chain according to the present invention entrained therearound.
Figure 5:
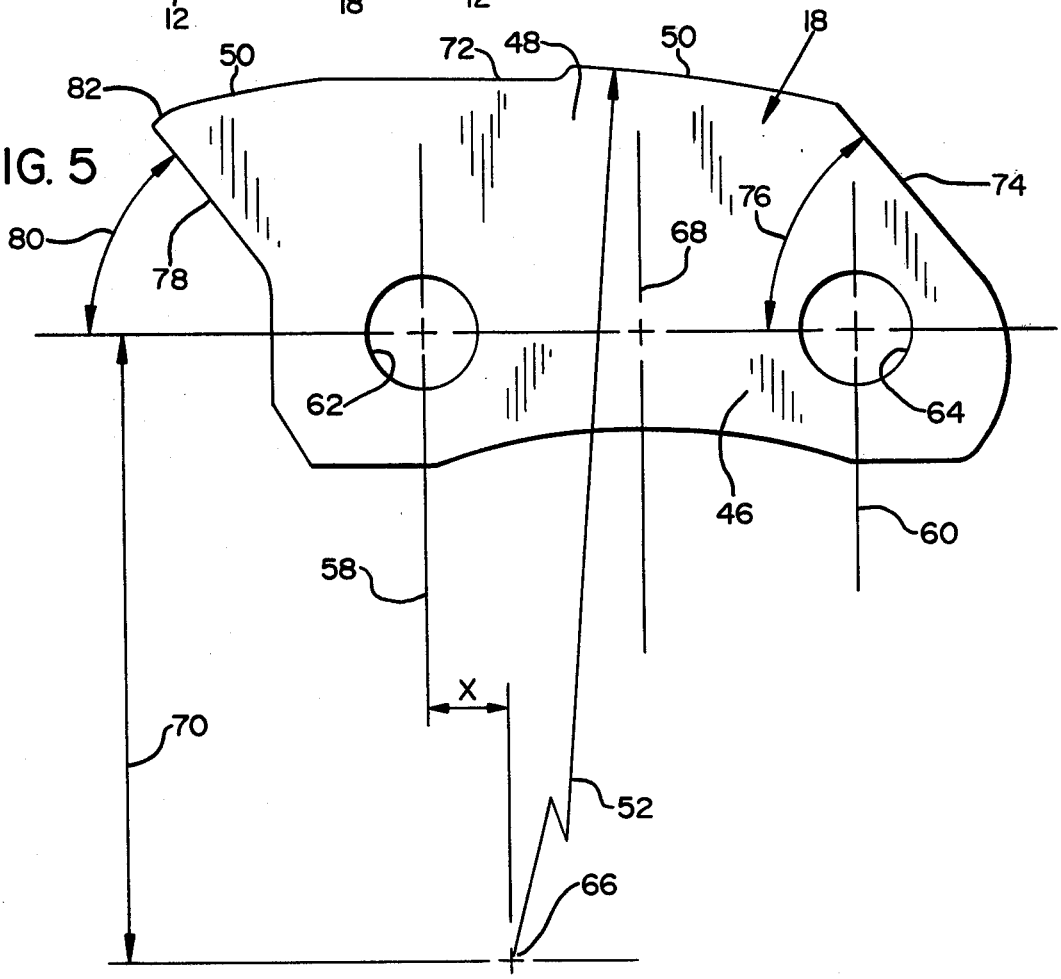
FIG. 5 is an enlarged side view of a guard link according to the present invention.

Referring to FIG. 4, illustrating the saw chain entrained around a saw bar, and to FIG. 5, illustrating the guard link 18 in greater detail, the radius of curvature 52 of top edge 50 will be seen to be approximately equal to the radius of curvature of the nose end of the saw bar 54 (FIG. 4) with which the saw chain is employed plus a relatively constant value corresponding to the height of the guard link, and the center of curvature is in the region of the center of curvature 56 of the saw bar with such center of curvature preferably lying between the vertical center lines 58 and 60 of rivet holes 62 and 64 at the rearward and forward ends of the guard link. It is also preferred that the center of curvature be located rearward of a vertical center line 68 between the two rivet holes. In a particular example wherein the pitch between rivet hole center lines was 0.390 inches, the center of curvature 66 was located a distance X equaling 0.07 inches forward of center line 58. This construction tends to cant the guard link upwardly at its rearward most end as it traverses the nose of the saw bar. For the particular link described, the center of curvature 66 was positioned at a distance 70 below the horizontal center of the rivet holes equaling 1.07 inches, and the radius 52 equaled 1.306 inches, resulting in a guard link height above the horizontal center of the rivet holes of 0.236 inches. It is of course understood these measurement values are exemplary only and are not to be taken in a limiting sense. In the typical saw chain according to the present invention, the height of the cutter tooth above the rivet hole centers was 0.268 inches while the height of the depth gauge peak above rivet hole centers was 0.243 inches. In general, the height of the top edge of the guard link in relatively close spaced relation to the bottom of the kerf being cut is less than the height of the depth gauge and within about ten percent of the height of the depth gauge as taken above the respective rivet hole centers. Although the top edge 50 preferably comprises a substantially continuous curve, the top edge can be notched out as at 72 to provide a top flat edge parallel to the horizontal center line between the rivet openings to accommodate the filing of the depth gauge on the succeeding cutter link. This notch may be of a variably selectable size.

The body portion of the guard link is provided with a forward edge 74 which rises steeply toward the top edge 50 in obtuse angular relation to the top edge for defining a forward terminus of the top edge in close proximity to the bottom of the kerf 30 whereby the body portion substantially fills the space between cutter links, and whereby to provide a top bearing surface or skid of a length to inhibit penetration of wood or brush into the region between cutter links. The length of the top edge in close proximity to the bottom of the kerf is desirably at least as long as the major part of the length of the guard link, and in the illustrated embodiment is nearly as long as the guard link. In the illustrated embodiment, the angle 76 (FIG. 5) between forward edge 74 and the horizontal was equal to 50°, and is preferably in the range between 40° and 60°. This relatively steep angle, in addition to elongating the top edge 50, also helps the guard link move wood chips along the kerf without binding, i.e. aids in carrying chips out of the kerf rather than compressing the same. That is, the chips are urged out of the way rather than being compressed against the bottom of the kerf and energy is not expended in camming material away, nor does the guard link tend to bind and rotate. However, a greater angle than 60° is not desired since binding at the top corner might result. The juncture between the forward edge and the top edge is advantageously above rivet hole 64 whereby such juncture remains at a constant distance above the saw bar as the saw chain moves around the saw bar.

The guard link has a rearward edge 78 which is also inclined upwardly and rearwardly, meeting the top edge rearwardly of the base portion 46 of the guard link, thereby elongating the top edge to near the length of the guard link. The rearward edge 78 suitably makes an angle indicated at 80 of 50° with the horizontal, wherein said angle is desirably in the range between 40° and 60°. The rearward edge 78 is advantageously parallel to forward edge 32. The rearward most tip 82 of the guard link is cut downwardly slightly to enhance ease of manufacture, with the angle thereof being about 50° from the horizontal.

As will be noted from FIG. 1, the rearward edge 78 is positioned adjacent the forward part of depth gauge 28 when the saw chain traverses a relatively straight portion of the saw bar, but preferably extends no farther rearwardly. Since the center of curvature of the top edge of the guard link is rearward of the center line of the guard link, the rear end of the guard link will cant upwardly when the saw chain traverses the nose of the saw bar as illustrated in FIG. 3. At such time, the rearward most part of the guard link draws closer to the kerf bottom 30' for providing added protection against kick back and entrainment of brush. However, the rearward most part of guard link 18 remains below kerf bottom 30, 30' and a line 84 (in FIGS. 1 and 3) extending between the top of the cutting tooth and the peak of the depth gauge of the following cutter link. Thus, the action of depth gauge 28 is primary in determining the depth of cut. A major function of the guard link is one of conditioning the kerf so that the depth gauge does not become seized in the wood and cam function in the intended manner. The elongated top edge of the guard link along the kerf is intended to restrict wood penetration into the region between successive cutter links of the saw chain as would cause undesired seizing, without interfering with the operation of the depth gauge on the cutter link. Boring with the saw chain according to the present invention is not substantially inhibited as would be the case with a guard link having an extended tail for altering the operation of the depth gauge. Moreover, operation of the saw chain is substantially improved as a result of the cooperative relation between guard link 18 and cutter link 12 having a rearwardly and upwardly sloping forward edge 32. Such forward edge 32 is less apt to entrain brush or cause a seizing type contact with the kerf than a more upright or straight depth gauge, and consequently the preceding guard link 18 is called upon to condition the kerf and exclude material to prevent seizing, kick back or entrainment of brush, and does not have such proportions as would interfere with the operation of the cutter link for boring and the like.

New and highly desirable results have been achieved with the saw chain according to the present invention in substantially reducing kick back and the like to minimal levels, while retaining excellent cutting and boring capabilities. The saw chain, because of its low seizing qualities, has also been found to operate very smoothly and easily without tiring the operator as much as conventional prior art chains.

While I have shown and described a preferred embodiment of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. A saw chain adapted to be driven around a path with a curved forward end portion, said saw chain comprising:

a plurality of cutter links alternating with guard links for preceding said cutter links, a said cutter link having an upstanding cutter tooth and an upstanding depth gauge located forwardly of said cutter tooth, said depth gauge having a height less than that of the cutter tooth, the top of said cutter tooth, during chain movement, defining the outer periphery of said path of said saw chain, a said guard link including an upstanding body portion having a top edge extending adjacent said outer periphery of said path of the saw chain, a rearward edge inclined upwardly and rearwardly toward said top edge substantially adjacent the depth gauge of said cutter link, and a forward edge rising comparatively steeply toward said top edge in obtuse angular relation to said top edge disposing said top edge in generally parallel relation with said outer periphery of said path and in close proximity to said outer periphery of said path over the major part of the length of said guard link wherein said guard link has a profile filling the majority of the space between the cutter tooth on a preceding cutter link and the depth gauge on a succeeding cutter link.

2. A continuous saw chain adapted to be driven around a path having a curved forward end portion, said saw chain comprising:

a plurality of center drive links alternating with pairs of side links wherein a pair of side links includes a cutter link pivotally secured to a given center link and is preceded by a pair of side links including a guard link pivotally secured to the same center link, said cutter link having an upstanding cutter tooth the top of which, during chain movement, defines the outer periphery of said path, and an upstanding depth gauge located forwardly of said cutter tooth, said depth gauge having a height less than that of the cutter tooth for determining the depth of cut, said depth gauge having a forward edge that is upwardly inclined to a peak located rearwardly of the center line of the pivotal connection between said cutter link and said given center link, said guard link including an upstanding body portion having a top edge extending toward the outer periphery of said path, a forward edge sloping rearwardly and upwardly toward said top edge meeting said top edge above the pivotal connection at the forward end of the guard link, and a rearward edge also sloping rearwardly and upwardly toward said top edge meeting said top edge rearwardly of the pivotal connection at the rearward end of said guard link and adjacent said depth gauge of said cutter link, wherein the top edge of said guard link is beneath a straight line extending between the top of said cutter tooth and the peak of said depth gauge, with said guard link, said given center link and said cutter link pivotally disposed in arcuate relation in traversing the curved end portion of said path.

3. The saw chain according to claim 2 wherein the entire top edge of said guard link is upraised to a relatively uniform height in relatively close spaced relation to the outer periphery of the path defined by the top of the cutter tooth.

4. The saw chain according to claim 2 wherein the top edge of said guard link is relatively parallel to the line of travel of said saw chain.

5. The saw chain according to claim 2 wherein the top edge of said guard link is curved, having a large radius of curvature compared with the height of said guard link and the pitch of the guard link between pivotal connections thereof.

6. The saw chain according to claim 5 wherein said radius of curvature is more than twice the pitch of said guard link between pivotal connections.

7. The saw chain according to claim 3 wherein the height of the top edge of said guard link is within about ten percent of the height of said depth gauge above the respective pivotal connections of said guard link and cutter link.

8. An elongated saw bar having a curved forward end, and a saw chain entrained for travel around said saw bar, said saw chain comprising:

a plurality of center drive links alternating with pairs of side links wherein a pair of side links includes a cutter link pivotally secured to a given center link and is preceded by a pair of side links including a guard link pivotally secured to the same center link, said cutter link having an upstanding cutter tooth and an upstanding depth gauge located forwardly of said cutter tooth, said depth gauge having a height less than that of the cutter tooth for determining the depth of cut, the path of the top of said cutter tooth including an arc as said cutter link traverses the curved end of said saw bar, said guard link including an upstanding body portion having a top edge extending in relatively close spaced relation to the said path of the top of the cutter tooth, a forward edge sloping rearwardly and upwardly toward said top edge meeting said top edge above the pivotal connection at the forward end of the guard link, and a rearward edge also sloping rearwardly and upwardly toward said top edge meeting said top edge rearwardly of the rearward pivotal connection of said guard link and adjacent said depth gauge of said cutter link, wherein the top edge of said guard link is beneath a straight line extending between the top of said cutter tooth and the peak of said depth gauge as the guard link traverses the curved end of said saw bar, and wherein the top edge of said guard link as said guard link traverses the curved end of said saw bar extends outwardly no farther than the arc described by the top of the cutter tooth as said cutter link traverses the curved end of said saw bar.

9. The apparatus according to claim 8 wherein the height of the top edge of the guard link is a relatively constant value above the radius value of the curved forward end of the saw bar.

10. The apparatus according to claim 8 wherein the top edge of said guard link is relatively parallel to the line of travel of said saw chain.

11. The apparatus according to claim 8 wherein the top edge of said guard link is curved, having a large radius of curvature compared with the height of said guard link and the pitch of the guard link between pivotal connections thereof.

12. The apparatus according to claim 11 wherein the radius of curvature of said top edge of said guard link is comparable to the radius of curvature of the forward end of said saw bar plus a constant value corresponding to the height of the guard link, with the center of curvature lying between the center lines of the pivotal connections at the forward and rearward ends of said guard link.

13. The saw chain according to claim 9 wherein said center of curvature is rearward of the center line between pivotal connections of said guard link.

14. The apparatus according to claim 11 wherein said radius of curvature is more than twice the pitch of said guard link between pivotal connections.

15. The apparatus according to claim 8 wherein the height of the top edge of said guard link is within about ten percent of the height of said depth gauge above the respective pivotal connections of said guard link and cutter link.

16. An elongated saw bar having straight edge portions and a curved forward end, and a saw chain entrained for travel around said saw bar, said saw chain comprising:

a plurality of cutter links alternating with guard links for preceding said cutter links, a said cutter link having an upstanding cutter tooth and an upstanding depth gauge located forwardly of said cutter tooth, said depth gauge having a height less than that of the cutter tooth, the path of the top of the cutter tooth describing an arc as it traverses the curved end of said saw bar, a said guard link including a base portion, and a body portion extending upwardly from said base portion, said base portion having front and rear pivotal connections with said saw chain, said body portion having an upraised top edge contoured to be in substantial alignment along the path of the top of the cutter tooth, said body portion having a rearward edge inclined upwardly and rearwardly toward said top edge of said body portion rearward of said base portion and substantially adjacent the depth gauge on the following cutter link when said saw chain traverses a substantially straight edge portion of said saw bar, and said body portion having a forward edge which rises steeply toward said top edge in obtuse angular relation to said top edge locating said top edge in generally parallel relation to said path of the top of the cutter tooth and in close proximity to said path of the top of the cutter tooth over the major part of the length of said guard link to provide said guard link with a profile filling the majority of the space between the cutter tooth on the preceding cutter link and the depth gauge on the succeeding cutter link, wherein the top edge of said guard link remains beneath a straight line extending between the top of the cutter tooth on the cutter link next succeeding said guard link and the peak of said depth gauge on said cutter link next succeeding said guard link as the guard link traverses the curved end of the saw bar and wherein the top edge of said guard link extends outwardly no farther than the arc described by the top of said cutter tooth as the guard link traverses the curved end of the saw bar.

17. An elongated saw bar having a curved forward end, and a saw chain entrained for travel around said saw bar, said saw chain comprising:

a plurality of center drive links alternating with pairs of side links wherein a pair of side links includes a cutter link pivotally secured to a given center link and is preceded by a pair of side links including a guard link pivotally secured to the same center link, said cutter link having an upstanding cutter tooth and an upstanding depth gauge located forwardly of said cutter tooth, said depth gauge having a height less than that of the cutter tooth and extending toward the bottom of the kerf cut by the saw chain for determining the depth of cut, said depth gauge having a forward edge that is upwardly inclined to a peak located rearwardly of the center line of the pivotal connection between said cutter link and said given center link, the top of the cutter tooth of said cutter link describing a path as said saw chain traverses said saw bar, said path including an arc as the top of said cutter tooth traverses the curved end of said saw bar, said guard link including a base portion having front and rear rivet receiving openings for pivotal engagement with drive links of said saw chain, said guard link further including a body portion extending upwardly from said base portion and having a top edge for positioning toward the bottom of the kerf being cut by said saw chain in substantial engagement with wood penetration in the region between cutter links, said top edge being curved with a radius of curvature generally comparable to the radius of curvature of the curved end of said saw bar, the center of curvature lying between center lines of the front and rear rivet receiving openings in said base portion, the forward edge of said body portion being inclined rearwardly and upwardly toward said top edge for intersecting said top edge substantially over the position of said forward rivet opening, and the rearward edge of the body portion being inclined upwardly and rearwardly for intersecting said top edge rearward of said base portion, wherein the top edge of said guard link including the portion thereof rearward of the rear rivet receiving opening remains beneath a line extending between the top of said cutter tooth and the peak of said depth gauge and wherein the top edge of said guard link including the portion rearward of the rear rivet receiving opening extends no farther outwardly than the path of the top of the cutter tooth as the guard link traverses the saw bar.

18. The apparatus according to claim 17 wherein the center of curvature of said top edge is rearward of a center line halfway between rivet openings in said base portion, whereby the rearward edge of said guard link moves upwardly relative to the center of curvature of the nose end of a saw bar as said guard link traverses therearound.

* * * * *